United States Patent [19]

LeBron, III

[11] 4,190,178

[45] Feb. 26, 1980

[54] DROP SHELF VENDING MECHANISM

[76] Inventor: Roderick R. LeBron, III, 6120 N. 30th St., Omaha, Nebr. 68111

[21] Appl. No.: 910,227

[22] Filed: May 30, 1978

[51] Int. Cl.[2] ..... G07F 11/06

[52] U.S. Cl. ..... 221/90; 194/2

[58] Field of Search ..... 221/89, 90, 110; 194/2

[56] References Cited

U.S. PATENT DOCUMENTS

| | | | |
|---|---|---|---|
| 2,623,804 | 12/1952 | Neidig | 221/90 |
| 2,884,163 | 4/1959 | DuGrenier et al. | 221/90 |
| 3,018,920 | 1/1962 | Weber | 221/90 |
| 3,037,663 | 6/1962 | Steiner | 221/90 |
| 3,137,411 | 6/1964 | Bailey | 221/90 |
| 3,556,343 | 1/1971 | Ungerman | 221/90 |

OTHER PUBLICATIONS

"Vend-A-Matic" brochure, published 3-4-78.

*Primary Examiner*—Joseph J. Rolla
*Attorney, Agent, or Firm*—Glenn K. Robbins

[57] ABSTRACT

A vending machine using a drop shelf trigger operated vending mechanism. The drop shelf vending mechanism employs a rack having vertically aligned drop shelves having a square shaft which is axially slidable within a square hole provided in a wall of the rack. A rounded end portion of the shelf extends beyond the square hole in one side of the rack and is adapted to be contacted by an upwardly spring biased trigger that fits around and into the shaft inwardly into registry with the squared hole in the side wall of the rack where the drop shelf drops to release the article. The trigger mechanism is operated by a trip lever contacted by conventional coin actuating mechanism which turns an operating shaft upon which the trigger is slidably mounted. The trigger is spring biased upwardly on the shaft to contact in sequence the lower most and then further drop shelves. A trigger stop on the trigger stops the trigger at each unoperated drop shelf in sequence. The spring biased member urges the trigger upwardly as each drop shelf is operated to the next drop shelf mechanism. A sold-out stop is provided at the top which is in the path of the trigger and prevents further operation to prevent movement of the operating shaft mechanism and blocks the coin receptacle to prevent further acceptance of coins in the sold-out condition.

14 Claims, 11 Drawing Figures

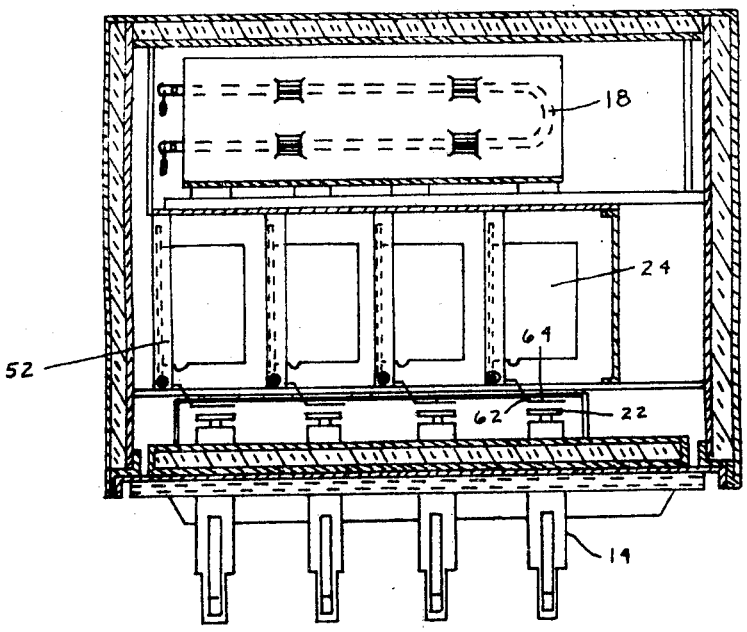
FIG 4
FIG 10
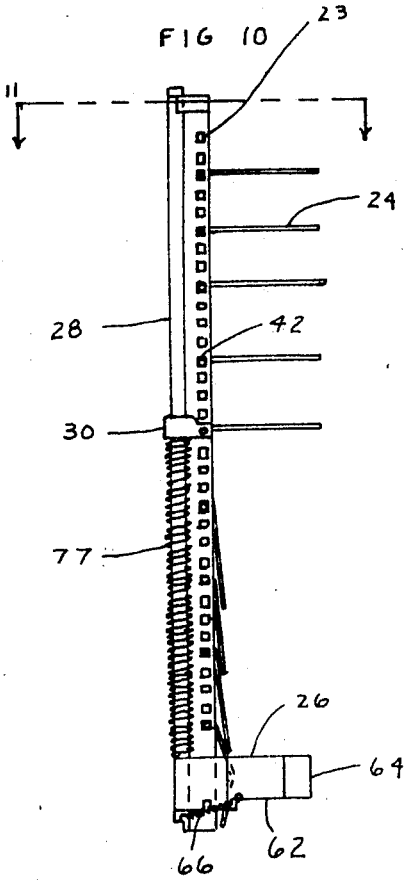
FIG 11
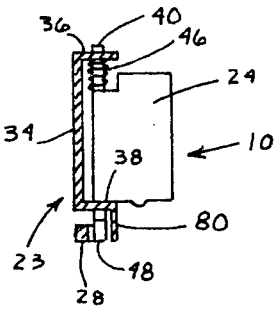

DROP SHELF VENDING MECHANISM

SUMMARY OF THE INVENTION

In the past various types of vending machines have been provided for vending a wide variety of articles or mechandise including various types of packaged foods and the like. In such vending machines, it has always been an object to provide for simplified loading accommodation for different size objects and a simple and relatively maintenance free type of vending operation. The cost and complexity of the vending machine structure is a further matter that favors efficiency and low capital cost.

By means of this invention there has been provided a drop shelf vending mechanism of a rack like construction which can be used for various types of objects to be vended which vary not only in weight but also in size. The vending mechanism employes a rack having vertical spaced drop shelves which operate by gravity once they are contacted by a trigger to drop the vended article into usual vending chute or drawer for reception by the user.

The rack employes a plurality of drop shelves which are connected to a square shaft received in opposing side walls of the rack. The square shaft at one side mates with corresponding square holes in the side wall. The shelf is released to vend or deliver the article when a rounded or circular cross-section end of the shaft is pushed into mating relation with the squared hole of the rack against the force of a biasing spring by an operating trigger. The trigger in turn is operated by the actuation of the coin mechanism causing the shaft to be moved by the trigger. The trigger mechanism is slidably mounted on a vertical operating shaft having a square cross-section. At the bottom of the operating shaft is a trip lever which is operated by the coin mechanism to rotate the operating shaft and cause the engagement of the trigger against the rounded end of the shaft of the drop shelf causing an inward movement and collpase for rotational movement by weight of the drop shelf to drop the shelf and dump or drop by gravity the article to be vended.

The trigger is spring biased on the operating shaft and moves upwardly in each vending operation to the next shelf where it is stopped by means of a trigger stop. The trigger is not further operated until the coin vending mechanism is again operated by causing another movement of the trip lever arm which turns the operating shaft and causes another engagement of the trigger with the rounded end of the drop shelf shaft.

A sold-out mechanism to prevent further operation is provided at the top of the rack by means of a stop which is positioned in the path of the trigger and prevents its rotational movement and blocks the movement of the operating shaft and the trip lever arm to block the coin operated mechanism from accepting and releasing any further coins.

The drop shelf vending mechanism of this invention can be easily installed and used by the vending machine supplier. It is adaptable for various types of objects to be dispensed and is simply loaded and operated in a variety of different types of vending operations.

The above features are object of this invention and further objects will appear in the detailed description which follows and will be otherwise apparent to those skilled in the art.

For the purpose of illustration of this invention, there is shown in the accompanying drawings a preferred embodiment thereof. It is to be understood that these drawings are for purpose of illustration only and that the invention is not limited thereto.

IN THE DRAWINGS

FIG. 4, is a view in horizontal section taken on the line 4—4 of FIG. 3;

FIG. 10, is a fragmentary view in side elevation of the drop shelf vending mechanism as in FIG. 3, with the bottom half of the shelves collapsed and the top half of the shelves in article supporting position;

FIG. 11, is a view in section taken on line 11—11 of FIG. 10;

DESCRIPTION OF THE INVENTION

Figure 1:
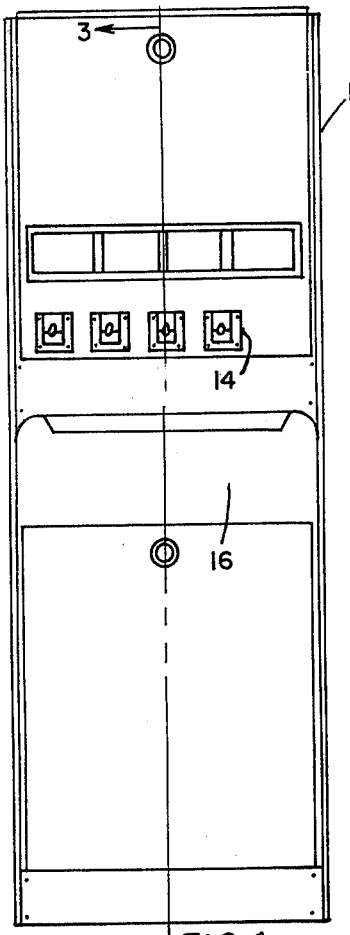
FIG. 1, is a view in front elevation of a vending machine equipped with the drop shelf mechanism.
Figure 2:
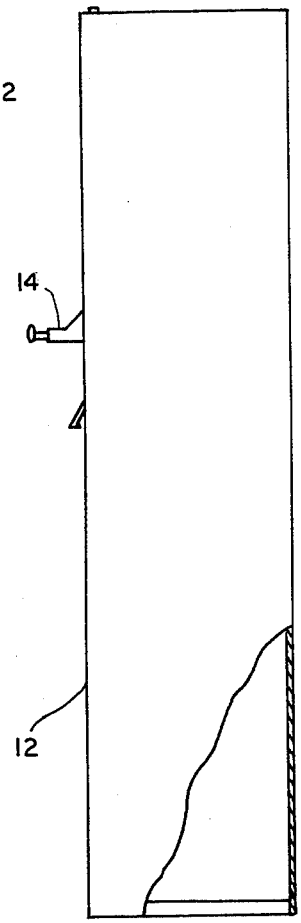
FIG. 2, is a view in side elevation taken from the right side of FIG. 1.

The drop shelf vending mechanism of this invention is generally identified by the reference numeral 10 and is shown incorporated in a vending cabinet 12 in FIGS. 1, 2, 3 and 4. The vending cabinet or machine is of the same general construction as that shown in Willard R. Abbott and Roderick LeBron U.S. Pat. No. 3,531,017 but as will be understood other types of cabinets housing the drop shelf vending mechanism may be used as desired.

The vending machine cabinet 12 is shown equipped with four identical coin mechanisms 14, each of which is accociated with a separate drop shelf vending mechanism. A hinged vending drawer 16 receives the vended articles which may be heated food articles, unheated food articles or other articles of mechandise conventionally handled by such vending machines. For purposes of heating food objects an electrical heating unit employing heating coils 18 may be employed while insulating panels 20 are employed about the upper walls of the cabinets.

The coin mechanism 14 is of conventional construction and employs a pusher bar 22 which is actuated by the insertion of a coin. The pusher bar 22 is employed to actuate the drop shelf vending mechanism and cause the release of the article through the vending drawer 16.

The drop shelf vending mechanism is best shown in FIGS. 3 through 11. It is comprised of a rack 23 which supports a plurality of vertically spaced drop shelves 24 connected by a shaft to the rack. A trip lever 26 is supported adjacent the bottom of the rack and is adapted to be contacted by the pusher of the coin mechanism to cause the operation of a vertical shaft 28. Slidably supported on the operating shaft is a trigger 30 which cooperates with a shaft supporting the drop shelves and causes them to be pushed inwardly to a point where a rounded end portion of the shaft associated with the drop shelf engages the holes supporting the shaft and permits the associated drop shelf to drop of its own weight and release the article to be vended for distribution to the customers through the vending drawer 16.

The drop shelf rack is best shown in FIGS. 10 and 11. It is comprised of a shallow C-shaped construction having side walls 36 and 38 which extend vertically and a back wall 34 connecting the aforementioned side walls. The individual drop shelves 24 are connected at the rear to a shaft 40 having a square cross-section which fits through a corresponding square shaped hole 42 in the side wall 38 of the rack and round holes in the side wall 36. A spacer tab 44 is provided at one of the side wall of the drop shelves to space the drop shelf in the droped position from the side wall 38 and prevent possible jamming.

The square shaped and mating configuration of the drop shelf shafts 40 in the square holes 42 of the rack prevent the drop shelf from being rotated or dropped until the trigger 30 as will be further described, causes its release. A biasing spring 46 urges the drop shelf to the position shown in FIG. 11 to maintain the squared relation and non-rotational position of the drop shelf in the rack until released by the trigger operation. A rounded end portion 48 having a circular cross-section at the end of the shaft adjacent the side wall 38 of the rack is provided in order that when the drop shelf is moved against the forces of the biasing spring 46 the engagement of the shaft end 48 permits the rotation of the shaft within the holes of the side walls of the rack and permits the rotation of the drop shelf by gravity to drop and release the object to be vended for distribution to the customer.

Figure 3:
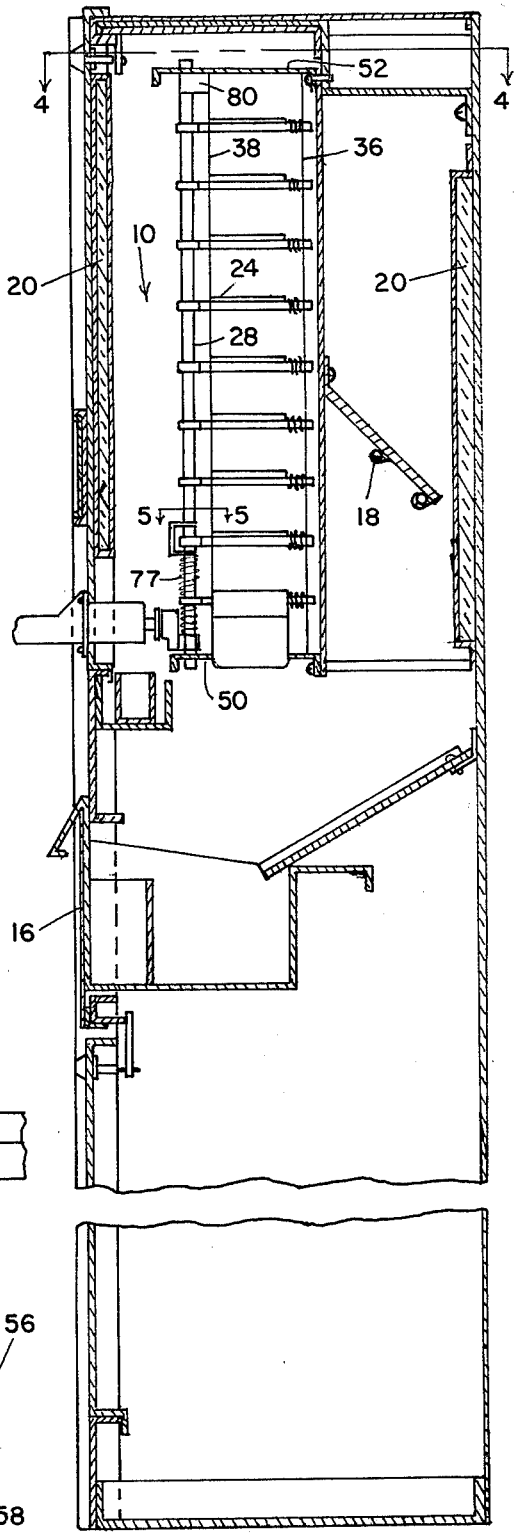
FIG. 3, is an enlarged view in vertical section taken through the center of the apparatus on line 3—3 of FIG. 1.

The trip lever 26 is best shown in FIGS. 3, 4, 8 and 9. The trip lever rests on a base plate 50 which supports the rack and is rotatably supported by the vertical operating shaft 28. A corresponding top plate 52 rotatably supports the top portion of the operating shaft as best shown in FIG. 3. The trip lever is comprised of a U-shaped bracket 54 having a top wall 56 and a bottom wall 58 connected by a side wall 60. The top and bottom side walls 56 and 58 have square holes corresponding with and receiving the square shaped operating shaft 28. Formed as an extension to the wall 60 is a Z-shaped arm 62 having an end portion 64 which is adapted to be contacted by the pusher bar 22 of the coin mechanism. The trip lever is spring biased by means of spring 66 to the position shown in FIGS. 4 and 10 and can be operated viewing the arm 62 in FIG. 4 through a counterclockwise position against the force of the biasing spring to cause the corresponding counterclockwise rotation of the operation shaft of the trigger.

Figure 5:
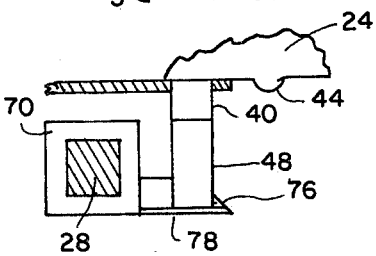
FIG. 5, is an enlarged view in section taken on the line 5—5 of FIG. 3 showing the trigger and shelf relationship.

The trigger 30 is best shown in FIGS. 3, 5, 6, 7 and 10. The trigger is comprised of a generally U-shaped bracket having a top wall 70 and a bottom wall 72 connected by a rear wall 74 and is of similar construction to that described for the trip lever. Square holes are provided in the top and bottom walls which loosely receives the operating shaft for relative sliding movement of the trigger on the shaft as that when the operating shaft is moved the trigger is correspondingly caused to move. The trigger is further provided with a trigger stop member 76 which is formed as an extension of the bottom wall 72 and is adapted to bear against the rounded end portion 48 of the drop shelf shaft by the upward force of the biasing spring 77 as shown in FIG. 5. In order to cause the actual movement of the drop shelf shaft and cause the release of the drop shelf the trigger is provided with a trigger striker or pusher 78 which is formed as an extension of the rear or wall 74.

For sold-out purposes and to prevent the operation of the coin mechanism when the last drop shelf has been operated, a stop 80 is provided as shown in FIGS. 3 and 11. The stop 80 when the trigger has advanced to its upper most position on the operating shaft is a force of the biasing spring 77 prevents the rotational movement of the operating shaft by blocking the trigger striker 78. By preventing the rotation of the operation shaft the trip lever can not be moved and the coin mechanism and pusher bar can not be operated thereby preventing the customer having the coin released in the coin mechanism.

OPERATION

The loading of the machine will be first described. To load when all the trays are collapsed the trigger 30 is depressed to the bottom most position manually. With the trigger held in this position the bottom most tray 32 is raised upwardly to the horizontal position at which point the square shelf shaft 40 registers with the square hole 42 in the side wall 38 where the square portion of the shaft engages the square hole 42 in the side wall 38 of the rack. This locks the shelf in position. When so locked the trigger stop 76 engages in a stout position the round end of the drop shelf shaft by the bearing of the trigger stop 76 against the underside or the shaft end. The additional shelves are raised in the like manner to the horizontal position where they are urged into the locked position through the square relation of the shaft with the square holes in the rack wall. The shelf mechanism may then be loaded with the various objects which are to be dispensed and the machine is ready for operation.

Figure 6:
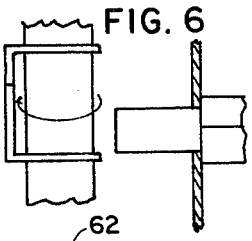
FIG. 6, is a right side view of the trigger and shelf relationship after the trigger has been operated and before movement to the next shelf station.
Figure 8:
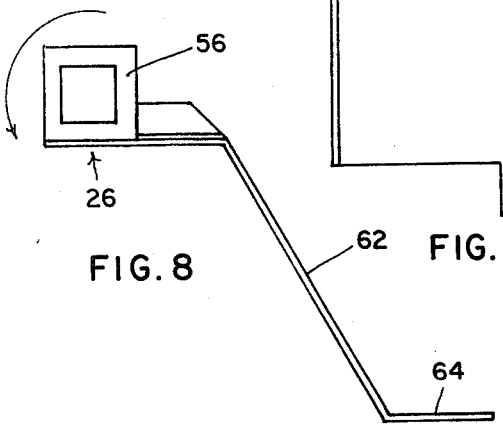
FIG. 8, is a plan view of the trip lever.
Figure 9:
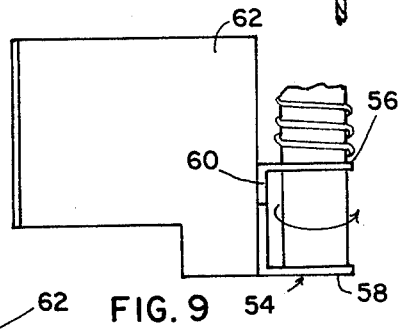
FIG. 9, is a right side view of the trip lever.
Figure 7:
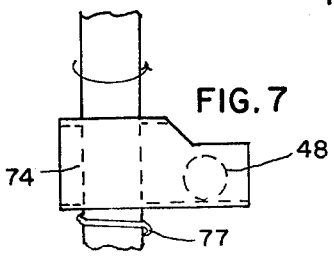
FIG. 7, is a view in front elevation of the trigger as shown in FIG. 5.

In the vending operation the customer in the usual fashion inserts the required coin in the coin acceptor mechanism 14. The mechanism is then operated by the customer by pushing in the usual fashion where the pusher bar 22 contacts the arm 64 of the trip lever 26. This manual movement causes the partial rotation of the operating shaft in the direction of the arrow shown in FIG. 10. A corresponding movement of the trigger as shown in FIGS. 5, 6, and 7 takes place. Thus the trigger or pusher element 78 is caused to bear against the rounded end portion 48 of the shelf shaft to cause it to move upwardly against the force of the biasing spring 46.

When moved to the position of the arrow in FIG. 5, and about 45° counterclockwise from this position the triggering or pushing operation is being completed and as shown in FIG. 6, the shelf shaft has been moved inwardly to the position where the rounded end is received in the square hole in the shelf rack side wall. The shelf drops by gravity to unload and dispense the vended article. FIG. 6, shows the relation of the trigger when returned 45° in the clockwise position and just before it is urged upwardly by biasing spring 77 to its next stop position in the next drop shelf position. In the dropped shelf position the shelf is maintained in this position by the shoulders of the squared portion of the shelf at the merging portion with the rounded end which butts against the side wall of the rack until the shelf is raised upwardly to the horizontal position for reloading as described above.

The next vending operation takes place in a similar manner and the trigger rises in stages as the next shelves are operated. As the trigger rides in such sequential vending operation the operation is repeated until the last shelf has been emptied. When this occurs, the trigger is moved to its upper most position by the biasing spring 77 and further operation in the sold-out condition is prevented by means of the stop 80.

The stop 80 as appears in FIG. 3, and 11 is in the rotary path of the trigger striker portion 78 and prevents the counterclockwise movement as shown in FIG. 5. In essence the stop is presented in the same position as the ends of the shaft as previously described. Thus since the trigger is blocked by the stop it can not be operated, the operating shaft can not be moved and the trip lever presents a stop or barrier to the movement of the coin vending mechanism and prevents the customer from having the coin released.

Reloading of the vending mechanism is accomplished in the same manner as previously described. Thus the trigger is moved manually to the bottom most position and the bottom most shelf is raised to the horizontal position where the shelf biasing spring 48 moves against the bottom most shelf shaft and urges the squared portion of the shelf shaft in registry and locking position in the corresponding squared hole in the side wall of the rack. The remaining shelves are raised in a like manner.

The drop shelf mechanism of this invention may be used not only in the vending cabinet as described but in various other types of vending cabinets as will be readily apparent to thos skilled in the art. Further, it will be apparent that where desired the front wall of the cabinet may be made transparent with windows and the articles may be viewed to determine the extent of availability of various items and the remaining articles left. The drop shelf vending mechanism may be operated so that a portion or all of the shelves are loaded as desired by the supplier of the vending machine. The mechanism is easy to load and it will be apparent that the rack holes and shelf shaft spacing of the shelves may be varied to accommodate different sizes of objects as desired.

Various changes and modifications may be made within this invention as will be readily apparent to those skilled in the art. Thus where the operating shaft and drop shelf shaft and the holes of the structure within which they interfit have been described as square it will be apparent that they may be rectangular, oval, keyhole, slotted or of other keyed or non-circular design. Such changes and modifications are within the scope and teaching of this invention as defined by the claims appended thereto.

What is claimed is:

1. A drop shelf vending mechanism comprising a rack, a plurality of vertically spaced drop shelves provided with shafts rotatably journalled in said rack and movable from a lock position to a freely rotatable unlocked position, trigger means for moving said shafts from a lock position to a freely rotatable position to drop a vending article supported on the shelf for distribution to a customer, an operating shaft supporting said trigger means in sliding relation thereon for movement of said trigger to an operative position for each of said drop shelves and a trip lever means connected to said operating shaft responsive to the operation of a coin selector means to rotate said operating shaft and operate said trigger, said drop shelf shaft having a squared shaft portion adjacent a rounded portion and said trigger being operable to move said shaft from a shelf locking position wherein said square shaft portion is slidably fitted within a mating square hole of said rack to the freely rotatable position wherein said rounded portion is journalled within said mating square hole.

2. The vending machine of claim 1, in which the rounded portion has a circular cross-section of a diameter substantially equal to the length of a side of the square cross-section of said squared shaft.

3. The vending machine of claim 1, in which the drop shelf is connected at a side wall to said shaft to provide an unbalance whereby when the shelf is locked in a horizontal position it freely rotates in the unlocked position to dump the article to be vended for distribution.

4. The vending machine of claim 1, in which the trip lever is comprised of a bracket member mounted on said operating shaft and is provided with an arm element engageable by a coin selector member to cause the rotation of said operating shaft from a trigger unoperated position to a trigger operating position responsive to the actuation of the coin selector means, and biasing means for returning said arm element and said operating shaft to a trigger unoperated position after a triggering operation.

5. The vending machine of claim 1, in which the rack is comprised of a pair of spaced vertically extending side walls, a first of said side walls being provided with a plurality of vertically spaced said square holes receiving in axially sliding relation the squared portion of said shaft and the adjacent rounded portion.

6. The vending machine of claim 5, in which a second said side wall has a plurality of vertically spaced round holes horizontally aligned with said square holes and means are provided biasing the drop shelf shaft toward the first said wall of the rack.

7. The vending machine of claim 5, in which the operating shaft is positioned adjacent and parallel to said first side wall and the trigger means is comprised of a bracket slidably keyed on said operating shaft to provide for relative axial sliding movement while causing the trigger bracket to rotate when said shaft is rotated and biasing means urging said bracket to slide on said shaft after a triggering operation on one shelf to a ready position for triggering the next adjacent shelf.

8. The vending machine of claim 7, in which biasing means are provided urging the rounded end portion of said shelf shaft and an adjacent squared portion through a square hole in said rack in the locked position of said shelf and stop means are provided on said trigger engageable with the end of the shelf shaft to position the trigger means adjacent said shaft until the shaft is released from the lock position by the triggering operation of said trigger means.

9. The vending machine of claim 8, in which the trigger means is provided with a striker element engageable with the rounded end of the shelf shaft to move said shaft axially and release the shelf from a locked position to a freely rotatable position to dump the vended article for distribution.

10. The vending machine of claim 1, in which the trigger means is comprised of a bracket slidably keyed on said operating shaft to provide for relative axial sliding movement while causing the trigger bracket to rotate when said shaft is rotated and biasing means urging said bracket to slide on said shaft after a triggering operation on one shelf to a ready position for triggering the next adjacent shelf.

11. The vending machine of claim 10, in which the bracket is provided with a stop means engageable with an end of the shelf shaft to restrain the sliding movement of the bracket and position the trigger means adjacent said shaft until the shaft is released from the lock position by the triggering operation of said trigger means.

12. The vending machine of claim 10, in which the bracket is provided with a striker element engageable with an end of the shelf shaft to move said shaft axially release the shelf from a locked position to a freely rotatable position to dump the vended article for distribution.

13. The vending machine of claim 10, in which a stop means is provided to block the operation of said trigger and said coin selector means after all the shelves have been released.

14. The vending machine of claim 13, in which said stop means is comprised of a first fixed member limiting the upward movement of said bracket on the operating shaft after the last shelf has been operated and a second fixed member positioned adjacent said striker element blocking the rotary movement of said trigger.

* * * * *